US005141223A

United States Patent [19]

Block

[11] Patent Number: 5,141,223

[45] Date of Patent: Aug. 25, 1992

[54] EXERCISE DEVICE

[75] Inventor: Stephen I. Block, Deerfield, Ill.

[73] Assignee: Spri Products, Inc., Wheeling, Ill.

[21] Appl. No.: 632,977

[22] Filed: Dec. 24, 1990

[51] Int. Cl.[5] ..... A63B 21/02

[52] U.S. Cl. ..... 482/124

[58] Field of Search ..... 272/139, 68, 143, 75; 2/80; 24/91, 72, 31 R, 69 A, 68 SP, 164

[56] References Cited

U.S. PATENT DOCUMENTS

| | | | |
|---|---|---|---|
| 1,402,179 | 1/1922 | Piscitelli | 272/139 |
| 1,506,631 | 8/1924 | Grover | 272/139 |
| 4,685,671 | 8/1987 | Hagerman | 272/139 |

FOREIGN PATENT DOCUMENTS

| | | | |
|---|---|---|---|
| 20463 | of 1907 | United Kingdom | 272/139 |

*Primary Examiner*—Richard J. Apley
*Assistant Examiner*—Jerome Donnelly
*Attorney, Agent, or Firm*—Connolly & Hutz

[57] ABSTRACT

An exercise device includes an elastic cord having a handle at one end which can be grasped by the user. The opposite end of the cord includes a fastener for attachment to a belt or other device worn at the waist of the user. Alternatively, the cord is attached to a belt especially designed for use with the cord.

7 Claims, 4 Drawing Sheets

10
12
14
15
16
17
18
20
22
24
26
B

Fig.9.
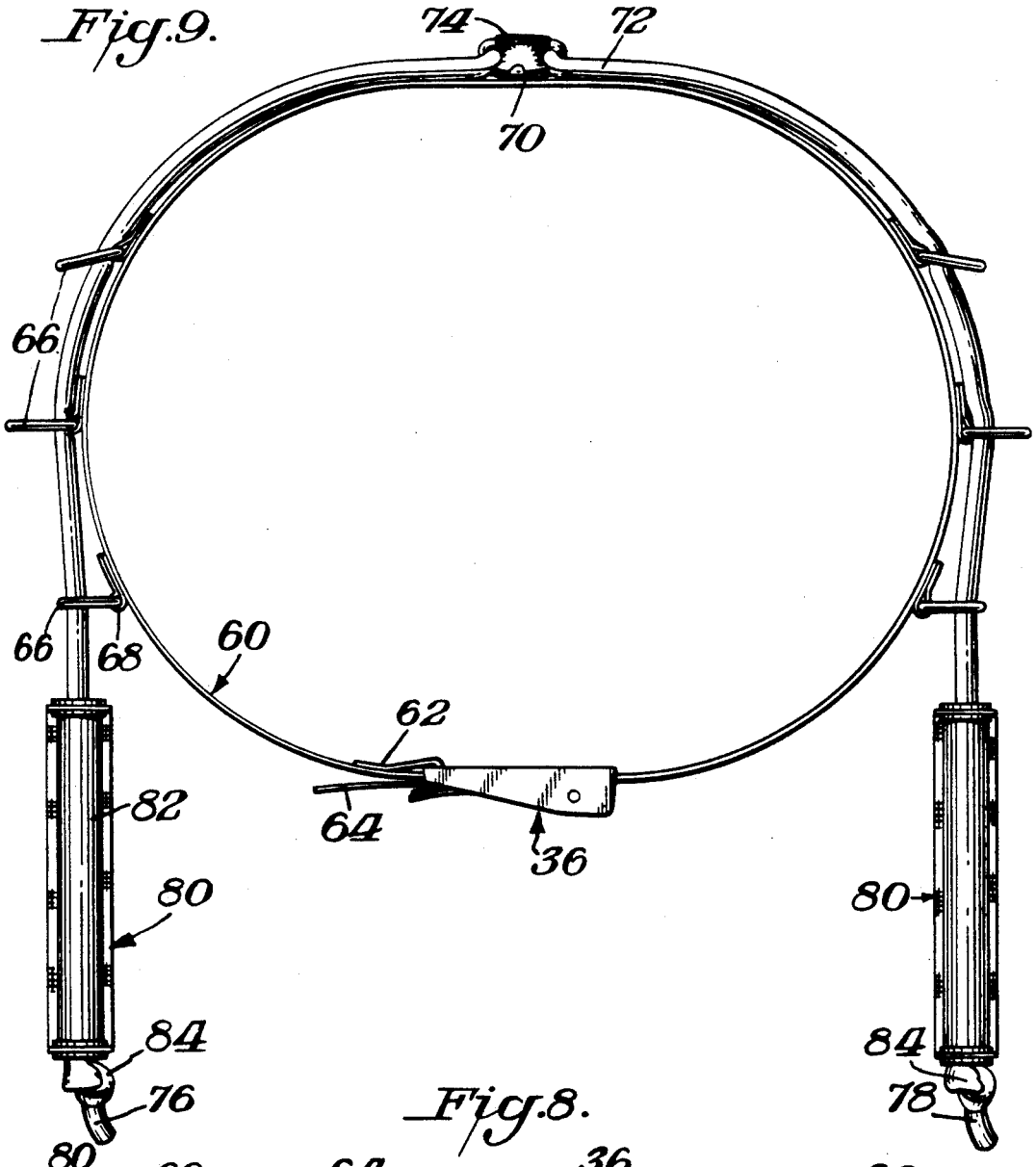
Fig.8.
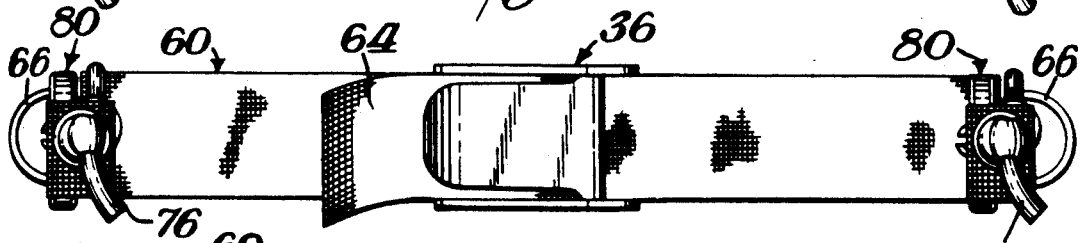
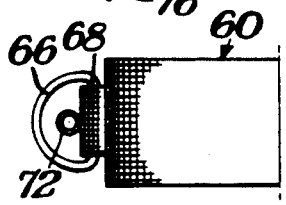
Fig.10.

EXERCISE DEVICE

BACKGROUND OF THE INVENTION

There has been a growing consciousness of the need for individuals to be in top physical condition. This has resulted in wide spread aerobic and anaerobic exercises, such as walking, jogging and running. In addition, the growing exercise consciousness has included the use of such equipment of various expense such as stationary bikes and treadmills.

It would be desirable if an exercise device would be provided to supplement the other forms of exercise so as to further tone the body while the user is simultaneously performing an aerobic or anaerobic exercise.

U.S. Pat. No. 4,961,573 discloses a boxing exercise harness which is intended to be used by a boxer during his training. The harness includes an elastic member having a handle which would be grasped by the boxer. The harness is of a generally complicated nature and utilizes, for example, a number of low friction members or pulleys and cables. While the harness may be useful for its intended purpose, namely, as a boxing exercise harness, the complicated nature of the harness does not lend itself to widespread appeal for the wide spectrum of potential users which range from casual exercisers to more serious athletes.

SUMMARY OF INVENTION

An object of this invention is to provide an exercise device which may be used in conjunction with other exercises.

A further object of this invention is to provide such an exercise device which is simple in construction and may be manufactured at low cost.

A still further object of this invention is to provide an exercise device which may be conveniently worn by the user without requiring complicated manipulations to achieve the intended result.

In accordance with this invention, the exercise device includes an elastic cord having a handle member at one end with a detachable hook or fastener at the other end so that the device may be fastened to the waist of the user. In one embodiment of the invention, the device may be fastened to the user's belt or a special belt may be constructed which permits adjustability in the selection of site of attachment.

THE DRAWINGS

FIG. 8 is a front elevational view of a modified belt used in accordance with this invention;

FIG. 9 is a top plan view of the belt shown in FIG. 8;

FIG. 10 is a front elevational view showing a ring of the belt shown in FIGS. 8-9;

DETAILED DESCRIPTION

Figures 1, 2, 3, 4:
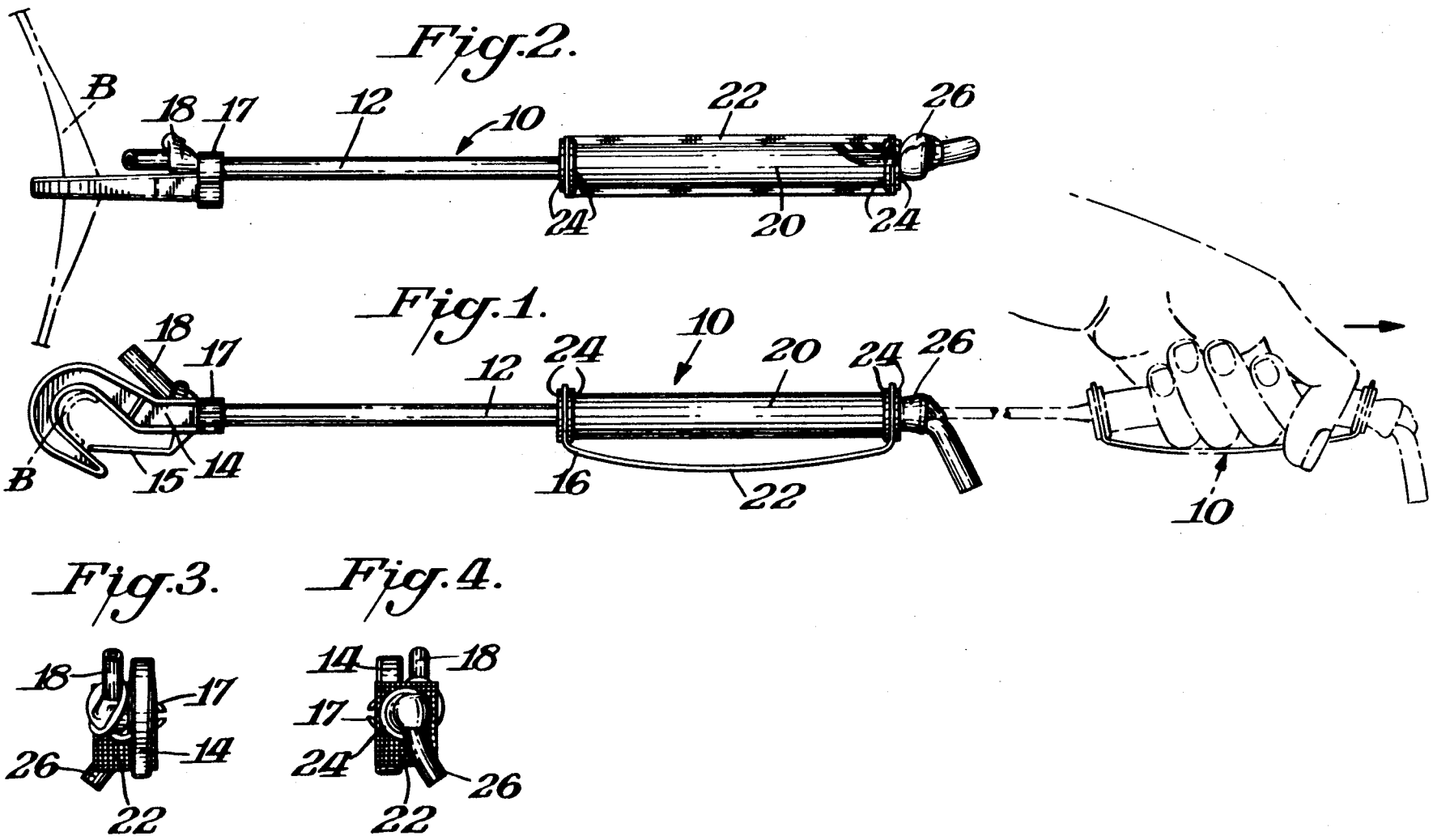
FIG. 1 is a front elevational view of one form of exercise device in accordance with this invention.
FIG. 2 is a top plan view partly in section of the device shown in FIG. 1.
FIGS. 3 and 4 are end elevational views of the device shown in FIGS. 1-2.

FIGS. 1-4 illustrate a simplified form of this invention which may be used by being applied to a conventional waist belt of the user or to a specialized belt which forms a part of this invention, as later described. As shown in FIGS. 1-4 exercise device 10 includes an elastic cord 12 having a fastener 14 at one end thereof for detachable securement at the waist of the user. In the illustrated embodiment fastener 14 is in the form of a rigid hook which would be clipped to the waist belt B of the user. Hook 14 includes a spring finger 15 which would capture the belt B within the hook portion of fastener 14. Cord 12 may be secured to fastener 14 in any suitable manner. In the illustrated form fastener 14 includes an offset 17 having an opening through which cord 12 passes. Cord 12 is then knotted to form an enlargement 18 which prevents fastener 14 from slipping off cord 12.

The opposite end of cord 12 includes a handle 16. Handle 16 may be formed in any suitable manner. In the illustrated form a sturdy non elastic textile member 22 is provided with a pair of washers or reinforced ring members 24 at each end thereof. Cord 12 is inserted through washers 24 so that a non-stretchable partial loop or spanning member 22 thereby results. A tubular sleeve 20 is disposed around cord 12 before the free end of cord 12 is inserted through the remote washer 24. Tubular sleeve 20 may be made of any suitable material which is selected to provide comfort to the user when the user grasps handle 16. For example, in the illustrated form tubular member 20 is simply a rubber tube of larger diameter than cord 12. Handle 16 is maintained on cord 12 by knot 26.

As illustrated in FIG. 1, when device 10 has been mounted to belt B at any suitable location, the user grasps handle 16 by wrapping the user's fingers around tube 20 and the user stretches device 10 by overcoming the inherent resiliency of elastic cord 12. This stretching is done in conjunction with the user performing other exercises wherein there would be a tendency for the user's arm to move away from the user's waist. Thus, for example, device 10 would be a useful aid in promoting cardiovascular health. Device 10 would provide a toning and firming of the upper extremity while the user is walking. The user could maintain the walking pace while increasing the resistance of device 10 by changing the location that device 10 is secured to the waist. The resistance could also be changed by a change in the elastic material of cord 12 or by changing the overall length of cord 12.

The form of invention illustrated in FIGS. 1-4 represents the simplest form of this invention wherein device 10 is simply clipped to the user's waist belt. The invention, however, is preferably practiced with specially formed belts which generally provide the desired adjustability in the selection of the location at which the device would be attached so as to afford better control in varying the resistance in accordance with the specific attachment locations.

Figure 6:
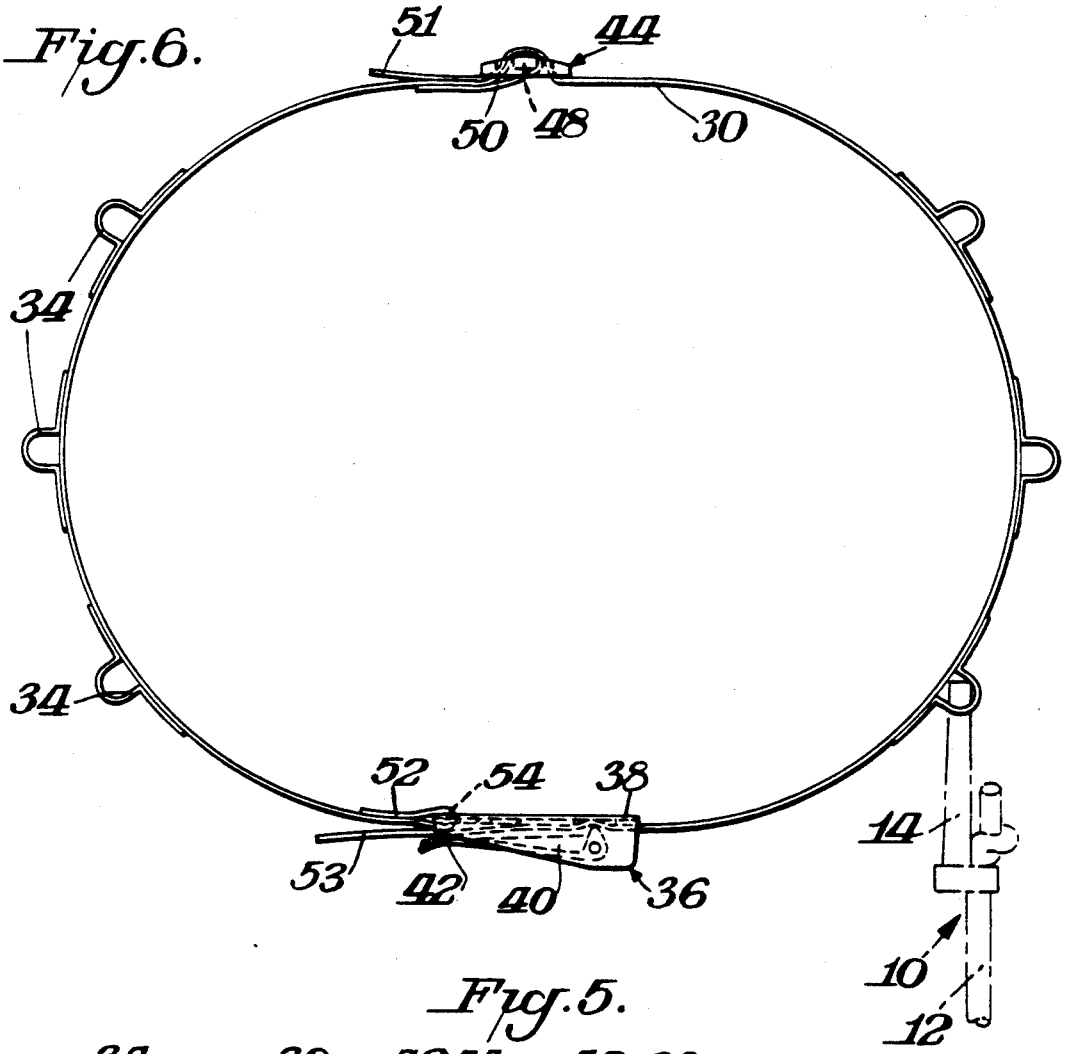
FIG. 6 is a top plan view of the belt shown in FIG. 5.
Figure 5:
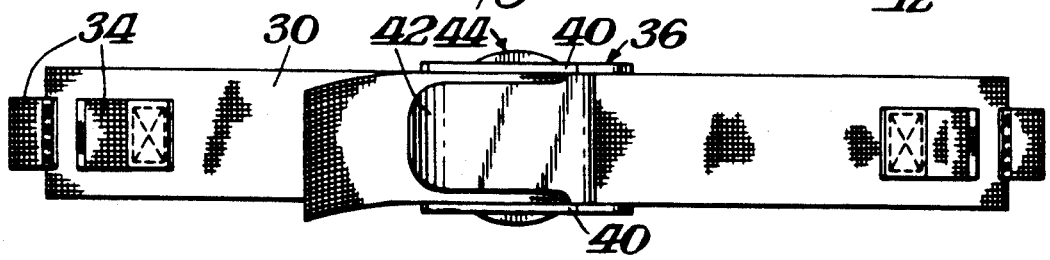
FIG. 5 is a front elevational view of a belt usable in this invention.
Figure 7:
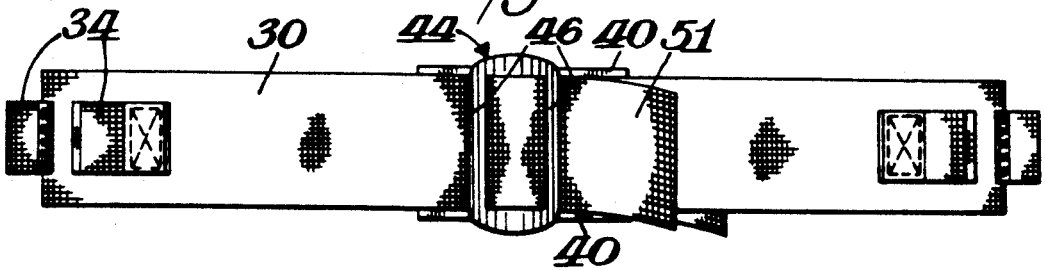
FIG. 7 is a rear elevational view of the belt shown in FIGS. 5-6.

FIGS. 5-7 illustrate a variation of the invention wherein a non-elastic belt 30 is shown which would be worn on the user's waist. Belt 30 would be made of a non-stretchable textile material similar to the material used for member 22. Belt 30 would include a set of spaced loops 34 on each side of belt 30 which would provide a selection of locations for the securement of fastener 14. Belt 30 would also include any suitable length adjusting member 36 to permit the belt to be mounted as tight of loose around the waist as desired. For example, length adjusting member 36 may include a bracket 38 having a pair of parallel flanges 40 to which a locking lever 42 is pivotally mounted. An end of belt 30 would be inserted between the base of bracket 38 and locking lever 42 and then clamped in position when locking lever 42 is pressed downwardly toward base 38 in contact with belt 30. Further length adjustment could be obtained by locking member 44 disposed diametrically opposite to length adjusting member 36. Locking member 44 is of conventional construction which includes having a pair of end legs 46 with an intermediate leg 48. Belt 30 would be made of two pieces. One end 50 of one of the pieces would be permanently mounted around center leg 48 and the opposite free end 53 would be slidably inserted into adjusting member 36. The other piece of belt 30 would have one end 52 permanently secured to a leg 54 of length adjusting member 36 with the opposite end of that portion of the belt adjustably mounted to bracket 44 by being threaded through the various legs of bracket 44 in a conventional manner.

FIGS. 8-10 illustrate yet another embodiment of this invention. As shown therein a non-elastic belt 60 is provided having one end 62 permanently secured to length adjusting member 36 with the other end 64 looped around the waist of the user and then slidably secured in length adjusting member 36. A series of guide loops 66 are fixedly secured at spaced locations to belt 60. Loops 66 may take any suitable form, but preferably are metal rings which are flattened at one section and loosely mounted to belt 60 by means of fabric members 68 which are sewn to belt 60 in a longitudinal orientation after being disposed around ring 66. Accordingly, ring 66 may freely rotate by the pivotal connection resulting from members 68.

In the embodiment shown in FIGS. 8-10 elastic cord 72 is fixedly attached to belt 60 rather than including a non-readily detachable fastener such as hook 14. As shown, flattened mounting ring 70 is located diametrically opposite to length adjusting device 36. Loop 70 is pivotally attached to belt 60 by fabric fastener 74 sewn to belt 60 and located transversely across belt 60. The elastic cord 72 is threaded through fastening member 74 and mounting ring 70. The free ends 76,78 of the elastic member 72 thus extend outwardly on each side of length adjusting member 36. A handle 80 would be provided at each free end of the same general construction as handle 16 which would include a tubular member 82 and a fabric member similar to tubular member 20 and fabric member 22 of device 10. Knot 84 would prevent handles 82 from sliding off the free ends of elastic member 72. As with device 10 tubular member 80 may be made of any suitable material such as a rubber tube or preferably a spongy type rubber which is particularly comfortable to grasp.

Although elastic cord 72 is firmly anchored to belt 60, cord 72 may also be detached for repair or replacement by a cord of different elastic characteristics. Handles 82 are dimensioned to snugly pass through guide rings 66 by bending the washers to slip through each ring. By manipulating mounting ring 70 it is also possible to unthread cord 72 from ring 70 and fastening strap 74 so that a handle 82 may pass through all of rings 66 and ring 70 to thereby detach cord 72 from belt 66.

Figure 12:
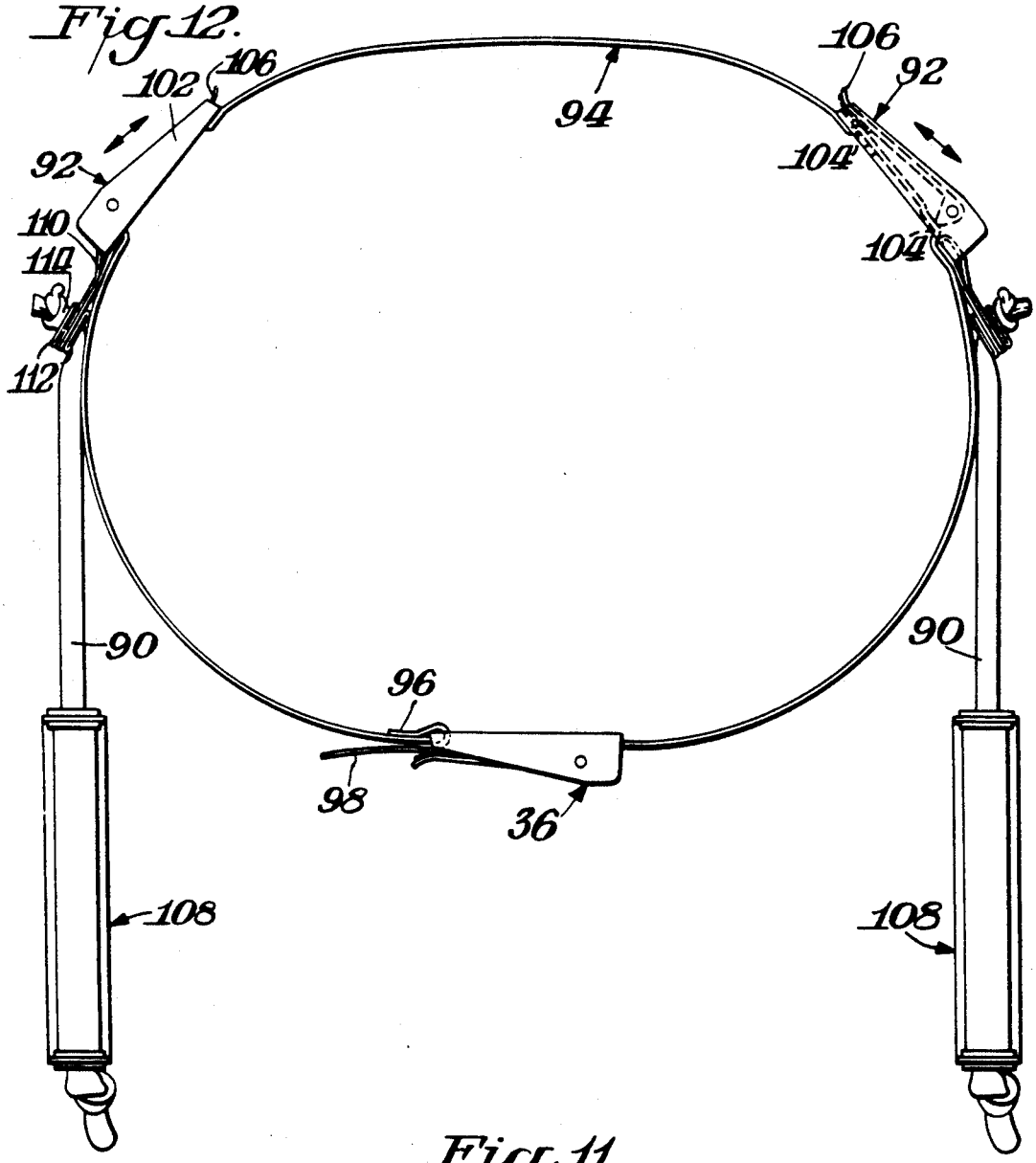
FIG. 12 is a top plan view of the embodiment shown in FIG. 11.
Figure 11:
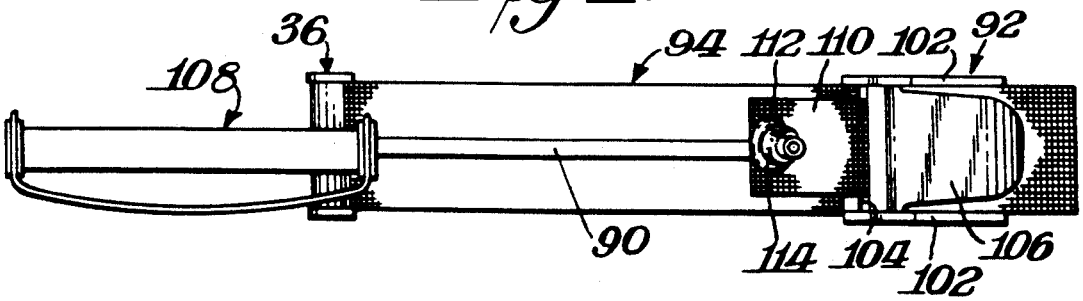
FIG. 11 is a front elevational view of yet a further embodiment of this invention.

FIGS. 11-12 illustrate a further embodiment of this invention wherein location of the elastic members 90,90 is varied by varying the location of location adjusting members or units 92,92. In this embodiment of the invention non-elastic belt 94 would be permanently secured at one end 96 to length adjusting member 36 while the free end 98 would loop around the waist of the user and would be slidably mounted in length adjusting member 36. Location adjusting carriers or members 92 would be formed in any suitable manner so as to be slidably mounted on belt 94 and then have the ability to be locked into place. The construction may be generally similar to member 36. For example, each location adjusting unit 94 would include a bracket 100 having a base with a pair of upstanding side walls 102. A series of slots 104 would be formed in the base of bracket 100 so that belt 94 could be threaded through bracket 100 by being inserted into the slot at one end of bracket 100 and out of the slot at the other end. A pivotal locking member 106 would be mounted to side walls 102 to engage the belt when it is desired to lock location adjusting member 92 in place. Thus, when pivotal locking member 106 is rotated away from the base of bracket 100, bracket 100 may be slidably moved toward or away from length adjusting member 36. When the desired location is reached for a location adjusting member 92 lever or pivotal locking member 106 would be rotated back toward the base of bracket 100 in the illustrated positions where its locking surface would press against belt 94 to prevent any relative movement of bracket 100 with respect to belt 94.

Each elastic cord 90 is secured at its end remote from handle 108 by being connected to a connecting flange 110. Connecting flange 110 may take any suitable form. In the illustrated embodiment connecting flange 110 is a non-elastic fabric strap like material which loops around one of the legs in the base of bracket 100 created by slot 104. The free ends of the fabric are then secured together in any suitable manner, such as by rivets or washers 112. An end of cord 90 is inserted through washers 112 and is maintained in place by knot 114.

Handle 108 may be of any suitable construction such as previously described with respect to handles 16 and 80.

In use of the device shown in FIGS. 11-12, resistance could be varied by changing the location of brackets 100 closer to or further from length adjusting device 36. The effect of this change in location is to increase the resistance when brackets 100 are moved away from the front of belt 94 or to decrease the resistance when brackets 100 are moved closer to the front of belt 94.

As can be appreciated, the invention thus provides an exercise device which is an effective adjunct to other types of aerobic or anaerobic exercises such as walking, jogging, running, stationary bike, treadmill, step or stair climbing, toning, shaping, etc. The invention can be effectively used to vary the resistance that is encountered in normal arm movements by either changing the locating at which the elastic members are attached to the user's waist or by using elastic members of greater or lesser elasticity.

What is claimed is:

1. An exercise device comprising a non-elastic belt to be worn around the waist of a user, elastic cords having a near end and a remote end, a gripping handle secured to said remote end of each cord, fastening means for selective securement to said belt at various locations around the waist of the user, said belt having a pair of ends selectively adjustably secured together by a length adjusting unit, said fastening means comprising a pair of locating adjusting carriers slidably mounted on said belt, each of said location adjusting carriers having a locking member for selectively locking its carrier to said belt, a connecting flange connected to each of said location adjusting carriers, a mounting ring secured to each of said connecting flanges, and each of said cords being secured to a respective one of said location adjusting carriers by being inserted through a respective one of said mounting rings.

2. The device of claim 1 wherein said handle comprises a spanning member secured at two spaced locations to said cord, and a tube around said cord between said two spaced locations.

3. The device of claim 2 wherein said spanning member and said tube are slidably mounted to said cord.

4. The device of claim 3 wherein said spanning member is made of a non-elastic material.

5. The device of claim 17 wherein said spanning member and said tube are slidably mounted to said cord.

6. The device of claim 18 wherein said spanning member is made of a non-elastic material.

7. The device of claim 1 wherein said connecting flange is a fabric strap inserted through its said location adjusting carrier, said strap having a pair of free ends, a rivet securing said free ends of said strap together to connect said strap to said location adjusting carrier, said rivet comprising said mounting ring, and said near end of said cord being knotted after insertion through said rivet.

* * * * *